US006334458B1

(12) United States Patent
Amaduzzi

(10) Patent No.: US 6,334,458 B1
(45) Date of Patent: Jan. 1, 2002

(54) BY-PASS VALVE IN PARTICULAR FOR PRESSURE-WASHING MACHINES

(75) Inventor: Roberto Amaduzzi, Rubiera (IT)

(73) Assignee: Arrow Line S.r.l., Rubiera (IT)

( * ) Notice: Subject to any disclaimer, the term of this patent is extended or adjusted under 35 U.S.C. 154(b) by 0 days.

(21) Appl. No.: 09/461,380

(22) Filed: Dec. 15, 1999

(30) Foreign Application Priority Data

May 21, 1999 (IT) ..... RE99A0065

(51) Int. Cl.[7] ..... F16K 17/00
(52) U.S. Cl. ..... 137/115.05; 137/115.06
(58) Field of Search ..... 137/115.05, 115.06, 137/115.15, 115.16

(56) References Cited

U.S. PATENT DOCUMENTS

| | | | | |
|---|---|---|---|---|
| 3,358,705 A | * | 12/1967 | Krechel | 137/115.16 |
| 3,999,568 A | * | 12/1976 | Chapman | 137/115.16 |
| 4,182,354 A | * | 1/1980 | Bergstedt | 137/115.15 X |
| 4,385,640 A | | 5/1983 | Iverson | |
| 5,086,975 A | | 2/1992 | Paige | |

FOREIGN PATENT DOCUMENTS

| | | |
|---|---|---|
| DE | 38 10341 | 9/1989 |
| EP | 0 734 791 | 10/1996 |
| GB | 2 082 733 | 3/1982 |

* cited by examiner

*Primary Examiner*—Stephen M. Hepperle
(74) *Attorney, Agent, or Firm*—Browdy and Neimark

(57) ABSTRACT

The invention relates to the sector of pressure-washing machines, in the form of a valve with by-pass function when the gun is closed, and allows reduction of the pressure inside the delivery duct during operation in by-pass mode. In particular this valve comprises an external housing (1) defining a chamber (2) provided with an inlet section (3), an outlet section (4) and a discharge section (5). It also comprises means (6) for shutting off the discharge section (5) or the outlet section (4), which are located inside the chamber (2) and actuated in a reciprocating manner by a difference in pressure and by resilient means (7) and provided with means (8) for communication between the inlet section (3) and the outlet section (5) operating during discharge of the flow through the discharge section (5).

14 Claims, 3 Drawing Sheets

BY-PASS VALVE IN PARTICULAR FOR PRESSURE-WASHING MACHINES

BACKGROUND OF THE INVENTION

1. Field of the Invention

The present invention relates to a by-pass valve in particular for pressure-washing machines.

2. Description of the Prior Art

Pressure-washing machines are normally used for washing using high-pressure water, where the delivery pressure reaches a value of the order of 100 bar or more, and may be used both at ambient temperature and in hot conditions.

A pressure-washing machine is connected to a washing gun generally supplied by a volumetric piston pump designed so as to delivery a constant flow of fluid. This gives rise to a few problems; firstly the operating pressure must be regulated and, since it is measured at the delivery outlet of the machine, it depends on the head losses in the fluid-dynamic circuit present between the pump delivery outlet and the environment; secondly, when the delivery gun is closed, it is necessary to discharge the flow, keeping the delivery pressure of the pump as small as possible so as to reduce the energy consumption and the wear thereof.

The problems listed above may normally be solved by introducing, downstream of the pump, a valve which regulates the washing pressure, discharging a part of the flow, thereby causing by-passing of the entire flow when the gun is closed or in the case where a pressure higher than a threshold pressure occurs inside the system. The by-passed water is conveyed back to the pump supply system.

As mentioned above, the said valve performs at the same time and in the same manner the discharging and safety functions: as soon as the pressure downstream of the valve exceeds a threshold value, the flow is by-passed and the zones respectively downstream and upstream of the valve remain isolated from each other.

The main problem which the abovementioned machines have is the considerable degree of rigidity to which the rubber pipe is subject as a result of the high pressure present inside it when the gun is closed. This limits considerably the ease of handling of the pipe and consequently of the washing gun.

In conventional machines, even after the pump has stopped, a high pressure exists inside the circuit which can be discharged by opening the gun. If the latter operation is not performed and in this situation any joint in the circuit is accidentally removed, there is a violent release of pressure with spray and a dangerous whiplash effect of any disconnected rubber pipes.

If the circuit is left under pressure after use, this causes in the long run damage to the rubber pipe and the gun, in particular in the event of exposure to the sun.

On account of the high pressure present, operation of the gun results in a strong reaction force due to the water flow. Normally there is a sudden delivery of the flow upon opening since the pressure is even higher than the operating pressure; this results in a violent reaction of the gun which may result in a dangerous loss of control by the operator, in particular at higher pressures.

Moreover, since the flow is discharged as soon as the pressure downstream of the valve exceeds a threshold value, the by-pass duct is continuously open and is therefore particularly subject to wear as a result of abrasion by the outflowing fluid.

OBJECTS OF THE INVENTION

The object of the present invention is to eliminate the abovementioned drawbacks by providing a by-pass valve in particular for pressure-washing machines, which allows the flow of the pump to be discharged via the by-pass when the gun is closed, allowing at the same time low pressure values in the whole delivery circuit.

A further advantage of the present invention consists in the fact that, by lowering the pressure inside the pipe when the gun is closed, the ease of handling is increased considerably also with respect to the condition where the gun is open.

Moreover, as a result of the present invention, it is possible to avoid problems or damage which may affect the rubber pipe and, in the event of accidental disassembly, also any injury to the user.

With application of the invention, operation of the gun requires a limited amount of force on the part of the operator, the pressure which is to be overcome in this case being limited. This fact, in addition to producing improvements during use, safeguards the activating mechanisms of the gun. In fact, during the transient stage where the gun obturator is opened, there is a limited pressure, a limited flowrate and therefore limited abrasive wear of the mechanisms, which is in particular undesirable during this stage.

In addition to that indicated above, the invention results in a gentle delivery of the flow at the start of each delivery cycle, due to its operating transient, which avoids a violent reaction of the gun and possible loss of control by the operator.

The invention, combined with the valve normally present in the system, prevents the latter from continuously opening the by-pass duct. This limits the wear, due to abrasion, of the outflowing fluid and increases the duration and the efficiency of the valve known as a safety valve.

This therefore results in a pressure-washing machine which is simpler, more reliable and safer to use.

SUMMARY OF THE INVENTION

Said objects are fully achieved by the by-pass valve in particular for pressure-washing machines, according to the present invention, as described by the contents of the claims indicated below and in particular comprising means for shutting off the discharge section or the outlet section, which are located inside the chamber and actuated in a reciprocating manner by a difference in pressure and by resilient means and provided with means for communication between the inlet section and the outlet section operating during discharging of the flow through the discharge section.

BRIEF DESCRIPTION OF THE DRAWINGS

These and other characteristic features will emerge more clearly from the following description of a preferred embodiment illustrated, purely by way of a non-limiting example, in the accompanying plates of drawings in which.

DETAILED DESCRIPTION OF THE PREFERRED EMBODIMENT(S)

Figure 1:
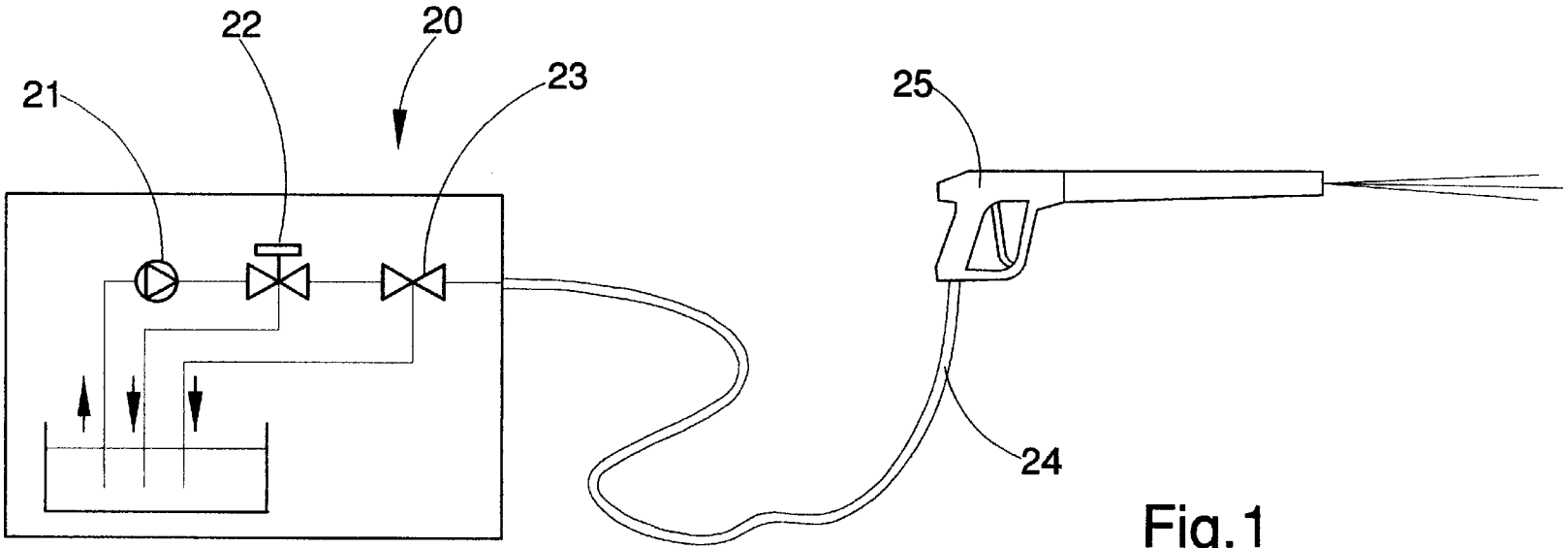
FIG. 1 shows a diagram of a pressure-washing machine comprising a by-pass valve according to the invention.

With reference to the Figures, 20 denotes in its entirety a pressure-washing machine comprising in particular a volumetric pump 21 of the known type, a maximum-pressure or safety valve 22 also of the known type, a functional by-pass valve 23 as per the invention, a flexible pipe 24 and a known delivery gun 25.

1 denotes an external housing of the by-pass valve 23, in particular for pressure-washing machines.

The abovementioned external housing has a substantially cylindrical extension and defines a chamber 2 through which a flow of fluid, in particular water, passes and which is provided with an inlet section 3, an outlet section 4 and a functional by-pass discharge section 5. The outlet section 4 consists of an element 15 for closing the said valve, which is inserted inside and fixed to the external housing 1 by means of a threaded connection 18. Other threaded connections 19*a,* 19*b* and 19*c* allow insertion of the valve into the system of a pressure-washing machine and in particular allow connection, respectively, of the inlet section 3, the outlet section 4 and the discharge section 5.

The chamber 2 is provided internally with means 6 for shutting off the discharge section 5 or the outlet section 4. These shut-off means 6 are provided with means 8 for communication between the inlet section 3 and the outlet section 4.

In particular the shut-off means 6 comprise a piston 9, sliding inside the chamber 2 between two portions 2*a,* 2*b* with different diameters, and between a first contact surface 10 and a second contact surface 11.

The first contact surface 10 consists of the end of the chamber 2 in the vicinity of the inlet section 3, while the second contact surface 11 is formed in the closing element 15 of the said valve.

The piston 9 is provided with a first internal channel 12 communicating with the inlet section 3.

The side surface of the piston 9 is provided with a few openings 13 which connect the first internal channel 12 to the discharge section 5 or to the portion 2*b* of the chamber 2, depending on the position of the piston 9. The communication means 8 comprise a second internal channel 14 with a limited cross-section which is formed in the end surface of the piston 9 and is such as to connect the first internal channel 12 to the portion 2*b* of the chamber 2, so as to establish communication between the inlet section 3 and the outlet section 4. Formed as a central channel or hole 14, the communication means 8 may, according to a variation not shown, be obtained for example in the form of a loose coupled arrangement of piston 9 and external housing 1, obtained by a leaving a larger amount of play or allowing for greater constructional tolerance during coupling of the two parts.

17 indicates a compression spring forming part of the resilient means 7 and inserted between the end surface of the piston 9 and the closing element 15 of the said valve.

Figure 2:
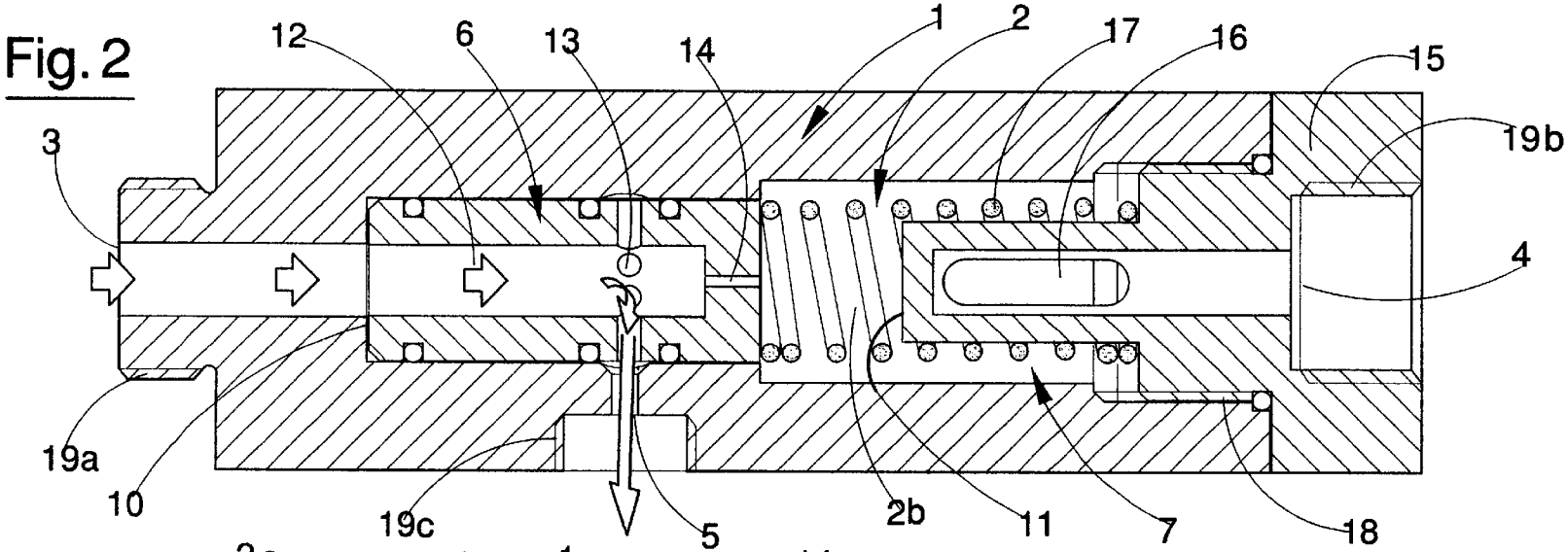
FIG. 2 shows a cross-sectional view of this functional by-pass valve during by-passing of the flow.

Shown as a spring 17, the resilient means 7 may, according to a variation of embodiment, also not be present inside the valve 1, being replaced by the resilience of the walls of the flexible piping 24 which results in a transitory reflux of fluid at the moment of closing of the gun 25, this return flow resulting in displacement of the piston into the by-pass position as shown in FIG. 2.

The closing element 15 is also provided with eyelets 16 communicating with the outlet section 4.

The valve as described above is inserted in a pressure-washing machine 20, downstream of the volumetric pump 21 and the safety valve 22 already forming the circuit of the machine itself, and upstream of the external gun 25, as shown in FIG. 1.

As regards operation of the abovementioned by-pass valve, with reference to the figures, three operating sequences of the said valve are illustrated.

The position illustrated in FIG. 2 shows the valve during by-passing of the flow with the gun closed.

The first internal channel 12 communicates with the inlet section 3 and with the discharge section 5, via the openings 13.

The water is discharged without encountering high fluid-dynamic resistance and therefore with limited, but pre-defined head losses, so that the pressure inside the circuit is kept low.

Since the discharge flow through the outlet section 4, and therefore through the communication means 8, is zero, the pressure between the portion 2*a* and the portion 2*b* is practically equal and balanced.

Any difference in pressure which may exist between the portion 2*a* and the portion 2*b* of the chamber 2 may be eliminated owing to the presence of the second internal channel 14 present in the end of the piston 9. When the flow through the second internal channel 14 is eliminated, the head losses and the difference in pressure upstream and downstream of the piston 9 are therefore also eliminated. The position shown in FIG. 1, when the gun is closed, is stable because the piston 9 is kept pressed against the first contact surface 10 by means of the compression spring 17.

When the gun is opened, the second internal channel 14, which has a limited cross-section and by way of guidance a diameter ø with a value of the order of 1 mm, is passed through by a flow insufficient for supplying the system downstream and the pressure downstream of the piston 9 is temporarily lowered, while upstream of the piston a limited pressure value remains.

It is envisaged that the force produced on the piston 9 by the pressure upstream of the piston itself (chamber 2*a*) exceeds the force of the compression spring 17 and the frictional forces: this is also obtained by suitably reducing the diameter ø of the channel 14 which generally must not exceed the value of 1 mm.

The abovementioned result is also obtained by increasing, if necessary, the value of the pressure inside the chamber 2*a* by means of the introduction of a random head loss such as, for example, a limited reduction in cross-section (not shown in the Figures) of the discharge duct 5.

The piston 9 then moves along the chamber 2 and closes the discharge section 5.

Figure 3:
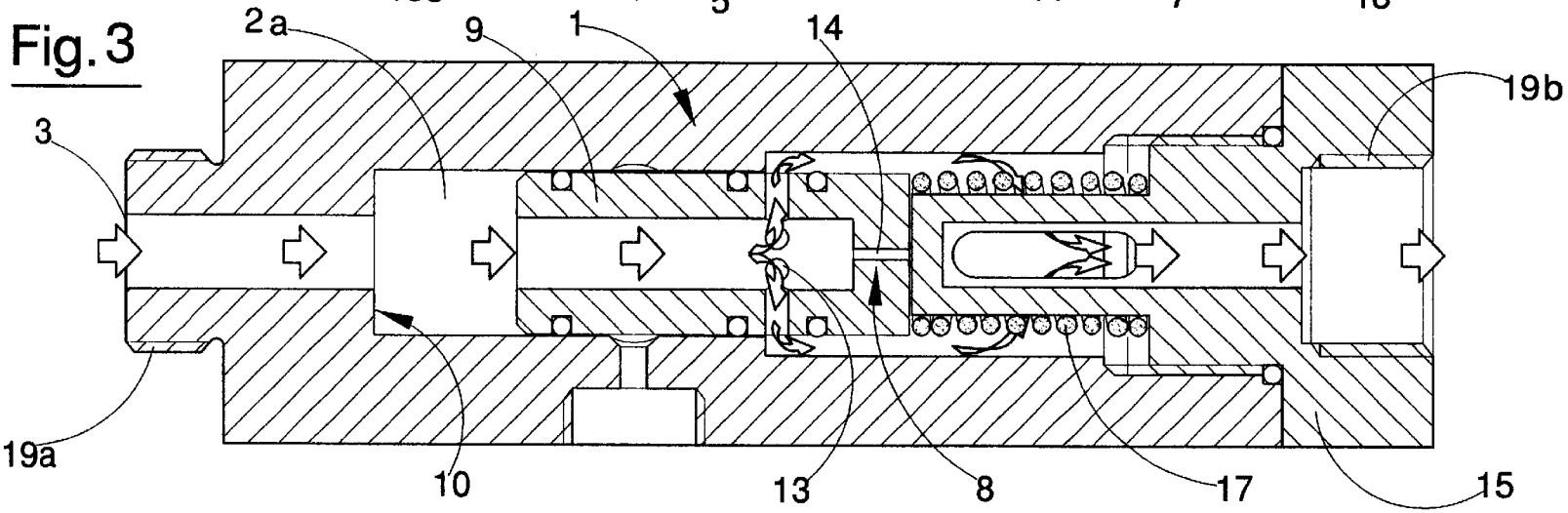
FIG. 3 shows a cross-sectional view of the same valve with the flow passing through it during normal use.
Figure 4:
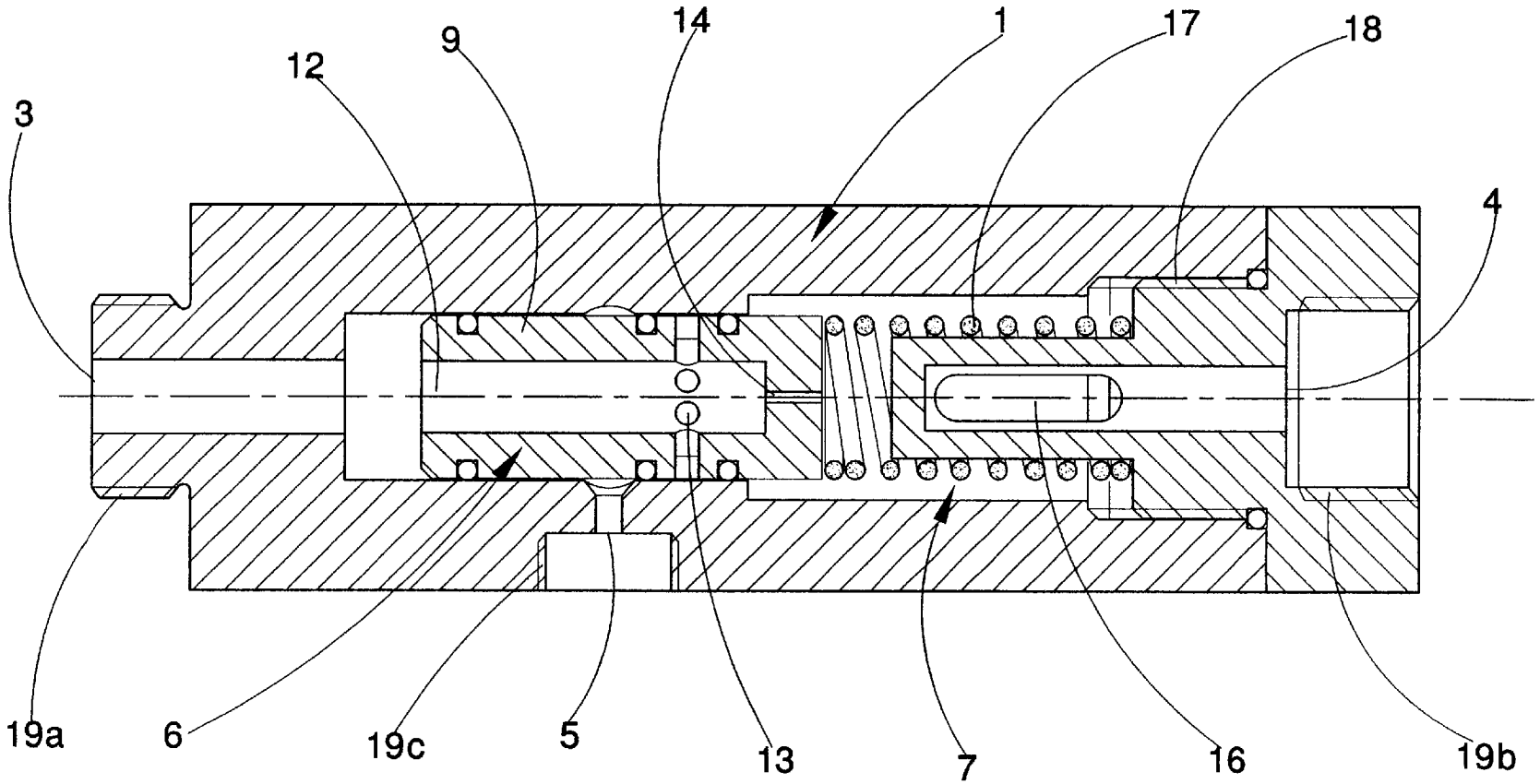
FIG. 4 shows a cross-sectional view of the valve during a transition stage, i.e. when passing from the position in FIG. 2 to the position in FIG. 3.

FIG. 4 shows the transition stage of the piston 9 when it passes between the position shown in FIG. 2 and the position shown in FIG. 3.

FIG. 3 shows the position of normal use of the by-pass valve described above, namely when the water flow flows from the inlet section 3 to the outlet section 4, while the discharge section 5 is closed by the said side walls of the piston 9.

When passing from the position shown in FIG. 2 to the position shown in FIG. 3, the pressure increases up to the working value which can be regulated by means of the safety valve 22 of the known type inserted upstream.

In this position, the apertures 13 are uncovered inside the cylindrical chamber 2*b* which is envisaged having a diameter greater than that of the chamber 2*a,* thus allowing the working flow to pass to the outlet 4 via the eyelets or holes 16.

On account of the twisting and random nature of the path inside the piston 9, the fluid which passes through it is subject to a pressure drop which produces a force on the said piston of a magnitude depending on the value of the actual pressure drop. This force is greater than the force of the spring 17 and keeps the piston 9 stably against the second contact surface 11, allowing the fluid to pass through the outlet apertures or eyelets 16 and the outlet section 4.

When the gun is closed again, the flowrate at the delivery outlet of the valve is zeroed, therefore also zeroing the head losses and the hydraulic force acting on the piston 9 which is therefore acted on only by the force of the spring 17.

The piston therefore reassumes the position shown in FIG. 2 where the flow of fluid is completely by-passed through the discharge section 5.

The invention as described above does not replace the safety and regulating valve 22 already inserted in the circuit of a pressure-washing machine of the known type. The object of the present invention is to replace the abovementioned valve only with regard to the by-passing function operating when the gun is closed. For this purpose, the form, the arrangement and the type of components may be varied without thereby departing from the scope of protection of the present patent.

Illustrated in the example shown as a functional by-pass valve 23 which is designed separate from the safety valve 22, the invention may, by way of a variation, be realised by forming said valves 22, 23 in a single body, the two functions and constructional structures as described above remaining separate.

What is claimed is:

1. A functional by-pass valve comprising an external housing (1) defining a chamber (2) provided with an inlet section (3), an outlet section (4) and a discharge section (5), wherein said by-pass valve comprises:

means (6) comprising a piston (9) slidable inside the chamber (2) for shutting off the discharge section (5) or the outlet section (4), said piston (9) being actuated in a reciprocating manner by a difference in pressure and by resilient means (7) and provided with means (8) for communication between the inlet section (3) and the outlet section (4), wherein the chamber (2) has two portions **(2*a*, 2*b*), said piston (9) has a side surface and is slidable inside the chamber (2) between the two portions (2*a*, 2*b*) and between a first contact surface (10) and a second contact surface (11), said piston (9) being provided with a first internal channel (12) communicating with the inlet section (3) and with openings (13) provided on the side surface of said piston (9), the second contact surface (11) is formed in a closing element (15) of the said valve, provided with apertures or eyelets (16) communicating with the outlet section (4), and the means (8) for communication comprise a second internal channel (14) formed in the end surface of the piston (9) so as to connect the inlet section (3) and the outlet section 4)**.

2. The valve as claimed in claim 1, wherein the two portions **(2*a*, 2*b*) of the chamber 2** are formed with respectively different diameters.

3. The valve as claimed in claim 1, wherein the second internal channel (14) has a cross-section with limited dimensions and with a diameter of the order of 1 mm.

4. The valve as claimed in claim 1, wherein the resilient means (7) comprise a compression spring (17) inserted between the end surface of the piston (9) and the closing element (15) of the said valve.

5. A functional by-pas s valve comprising an external housing (1) defining a chamber (2) provided with an inlet section (3), an outlet section (4) and a discharge section (5), wherein said by-pass valve comprises:

means (6) comprising a piston (9) slidable inside the chamber (2) for shutting off the discharge section (5) or the outlet section (4), said piston (9) being actuated in a reciprocating manner by a difference in pressure and by resilient means (7) and provided with means (8) for communication between the inlet section (3) and the outlet section (4), wherein the chamber (2) has two portions **(2*a*, 2*b*), said piston (9) has a side surface and is slidable inside the chamber (2) between the two portions (2*a*, 2*b*) and between a first contact surface (10) and a second contact surface (11), said piston (9) being provided with a first internal channel (12) communicating with the inlet section (3) and with openings (13) provided on the side surface of said piston (9), said valve has a closing element (15) disposed between said piston (9) and said outlet section (4) and in which the second contact surface (11) is formed, and the communication means (8) comprise a second internal channel (14) formed in the end surface of the piston (9) so as to connect the inlet section (3) and the outlet section 4)**.

6. The valve as claimed in claim 5, wherein the second internal channel (14) has a cross-section with limited dimensions and with a diameter of the order of 1 mm.

7. A functional by-pass valve comprising an external housing (1) defining a chamber (2) provided with an inlet section (3), an outlet section (4) and a discharge section (5), wherein said by-pass valve comprises:

means (6) comprising a piston (9) slidable inside the chamber (2) for shutting off the discharge section (5) or the outlet section (4), said piston (9) being actuated in a reciprocating manner by a difference in pressure and by resilient means (7) and provided with means (8) for communication between the inlet section (3) and the outlet section (4), wherein the chamber (2) has two portions **(2*a*, 2*b*), said piston (9) has a side surface and is slidable inside the chamber (2) between the two portions (2*a*, 2*b*) and between a first contact surface (10) and a second contact surface (11), said piston (9) being provided with a first internal channel (12) communicating with the inlet section (3) and with openings (13) provided on the side surface of said piston (9), said valve has a closing element (15) disposed between said piston (9) and said outlet section (4) and provided with apertures or eyelets (16) communicating with the outlet section (4), and the means (8) for communication comprise a second internal channel (14) formed in the end surface of the piston (9) so as to connect the inlet section (3) and the outlet section 4)**.

8. The valve as claimed in claim 7, wherein the second internal channel (14) has a cross-section with limited dimensions and with a diameter of the order of 1 mm.

9. A functional by-pass valve comprising an external housing (1) defining a chamber (2) provided with an inlet section (3), an outlet section (4) and a discharge section (5), wherein said by-pass valve comprises:

shut-off means (6) for shutting off the discharge section (5) or the outlet section (4), said shut-off means (6) being located inside the chamber (2) and being actuated in a reciprocating manner by a difference in pressure and by resilient means (7), and said shut-off means (6) being provided with means (8) for communication between the inlet section (3) and the outlet section (4), wherein said shut-off means (6) consist of a single moving part, and said single moving part is a piston (9) having a side surface provided with openings (13) that establish a flow path between the inlet section (3) and the discharge section (5) when said piston (9) is in a first position and between the inlet section (3) and the outlet section when said piston (9) is in a second position, which flow path is separate from said means (8) for communication.

10. The valve as claimed in claim 9, wherein the chamber (2) has two portions (2*a,* 2*b*), said piston (9) is slidable inside the chamber (2) between the two portions (2*a,* 2*b*) and between a first contact surface (10) and a second contact surface (11), and said piston (9) is provided with a first internal channel (12) communicating with the inlet section (3) and with the openings (13) provided on the side surface of said piston (9).

11. The valve as claimed in claim 10, wherein the two portions (2*a,* 2*b*) of the chamber (2) are formed with respectively different diameters.

12. The valve as claimed in claim 11, wherein: said piston (9) has an end surface; said valve further comprises a closing element (15); and the resilient means (7) comprise a compression spring (17) inserted between the end surface of said piston (9) and the closing element (15).

13. The valve as claimed in claim 10, wherein the means (8) for communication comprise a second internal channel (14) formed in the end surface of the piston (9) so as to connect the inlet section (3) and the outlet section 4).

14. The valve as claimed in claim 13, wherein the second internal channel (14) has a cross-section with limited dimensions and with a diameter of the order of 1 mm.

* * * * *